US007140556B2

(12) United States Patent
Cristiani et al.

(10) Patent No.: US 7,140,556 B2
(45) Date of Patent: Nov. 28, 2006

(54) FUEL INJECTOR WITH INJECTION VALVE PROVIDED WITH SIDE FEED

(75) Inventors: Marcello Cristiani, Imola (IT); Michele Petrone, San Lazzaro di Savena (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 0 days.

(21) Appl. No.: 11/222,225

(22) Filed: Sep. 9, 2005

(65) Prior Publication Data

US 2006/0060674 A1 Mar. 23, 2006

(30) Foreign Application Priority Data

Sep. 10, 2004 (IT) ..... BO2004A0560

(51) Int. Cl.
*B05B 9/00* (2006.01)

(52) U.S. Cl. ..... 239/125; 239/132.3; 239/132.5; 239/533.11; 239/533.13; 239/585.4; 239/900

(58) Field of Classification Search ..... 239/125, 239/128, 132, 533.11, 533.12, 584, 585.1, 239/585.4, 585.5, 900, 132.1, 132.3, 132.5
See application file for complete search history.

(56) References Cited

U.S. PATENT DOCUMENTS 3,958,757 A * 5/1976 Happel et al. ..... 239/125
4,230,273 A * 10/1980 Claxton et al. ..... 239/125
4,869,429 A * 9/1989 Brooks et al. ..... 239/132.5
4,971,254 A * 11/1990 Daly et al. ..... 239/900
6,698,674 B1 * 3/2004 Dantes et al. ..... 239/533.11
6,739,525 B1 * 5/2004 Dantes et al. ..... 239/533.11
6,764,031 B1 * 7/2004 Sebastian et al. ..... 239/533.12
6,811,105 B1 * 11/2004 Kato et al. ..... 239/585.1
7,021,558 B1 * 4/2006 Chenanda et al. ..... 239/125
2003/0116658 A1 6/2003 Dantes et al.
2003/0136380 A1 7/2003 Dantes et al.
2004/0055566 A1 * 3/2004 Stier et al. ..... 123/350

FOREIGN PATENT DOCUMENTS

WO WO 2004/074673 A1 9/2004

OTHER PUBLICATIONS

European Search Report—EP05108278—Dec. 22, 2005.

* cited by examiner

*Primary Examiner*—Steven J. Ganey
(74) *Attorney, Agent, or Firm*—Venable LLP; Robert Kinberg; Ryan M. Flandro

(57) ABSTRACT

A fuel injector provided with an injection valve comprising a mobile plunger; an injection jet having a plurality of first through-holes made starting from a chamber arranged downstream from the injection valve; a supporting body having a tubular shape and comprising a supply channel; and a sealing body, in which a valve seat of the injection valve is defined and the injection jet is provided; the sealing body is monolithic and has a disc-shaped plug member passed through by the injection jet, and a guide member, which rises up from the plug member, is tubular in shape, receives within it the plunger and has an external diameter smaller than the internal diameter of the supply channel, so as to define an external annular channel for the fuel; in the lower part of the guide member there are provided a number of second through-holes which open into the valve seat.

9 Claims, 2 Drawing Sheets

FUEL INJECTOR WITH INJECTION VALVE PROVIDED WITH SIDE FEED

CROSS-REFERENCE TO RELATED APPLICATION

This application claims the priority of Italian Patent Application No. BO2004A 000560 filed Sep. 10, 2004, the subject matter of which is incorporated herein by reference.

BACKGROUND OF THE INVENTION

The present invention relates to a fuel injector. The following description will make explicit reference, without consequently losing its general nature, to an electromagnetic injector for direct fuel injection.

An electromagnetic fuel injector comprises a cylindrical tubular body with a central supply channel which performs the function of a fuel duct and ends with an injection jet controlled by an injection valve operated by an electromagnetic actuator. The injection valve is provided with a plunger, which is rigidly connected to a mobile armature of the electromagnetic actuator so as to be displaced by the action of the electromagnetic actuator between a closed position and an open position of the injection jet against the action of a spring which tends to hold the plunger in the closed position. The valve seat is defined by a sealing member, which is disc-shaped, seals the bottom of the central channel of the supporting body, and is passed through by the injection jet.

An electromagnetic fuel injector of the above-described type has been proposed, in which a guide member rises up from the sealing member, which guide member is tubular in shape, receives within it the plunger to define a lower guide for said plunger and has an external diameter smaller than the internal diameter of the supply channel of the supporting body, so as to define an external annular channel through which the pressurised fuel flows. In the lower part of the guide member, there are provided four through-holes which open into the valve seat to allow the pressurised fuel to flow towards said valve seat. The plunger ends in a sealing head, substantially spherical in shape, which is capable of resting in sealing manner against the valve seat and rests so as to slide on a cylindrical internal surface of the guide member so that it will be guided as it moves. The injection jet is defined by a single through-hole, which is arranged downstream from the valve seat and passes through the sealing member.

With the aim of improving the performance of the above-described injector by producing an injection jet with a complex geometry, a new type of injector has subsequently been proposed, in which the guide member has an external diameter which is substantially equal to the internal diameter of the supply channel of the supporting body; recesses are provided in the sealing head in such a manner as to define channels between each recess and the internal cylindrical surface of the guide member which permit the fuel to pass towards the injection jet. The injection jet is of the "multi-hole" type, i.e. is defined by a plurality of through-holes, which are made starting from a hemispherical chamber made downstream from the valve seat; in this manner, it is possible to achieve optimum injection jet geometries for various applications by appropriately directing the individual through-holes.

Experimental testing has revealed that, when in service, the above-described electromagnetic fuel injector has a tendency to form an excessive quantity of fouling in the vicinity of the injection jet. Such fouling may bring about the partial or complete blockage of the through-holes of the injection jet, with an obvious negative impact on injector performance; in other words, the performance of such an injector tends to deteriorate too rapidly, unacceptably shortening the service life of the injector.

US2004055566A1 discloses a fuel injector for the direct injection of fuel into a combustion chamber of an internal combustion engine; the fuel injector has a valve needle, that has at its injector end a valve-closure member that works together with a valve-seat surface, formed on a valve-seat member, to form a sealing seat, and has at least one swirl duct, a swirl chamber formed on the valve-seat member, and a plurality of injection openings that open out from the swirl chamber, through which the fuel, provided with a swirl, is simultaneously injected.

US2003116658A1 discloses a fuel injector for the direct injection of fuel into a combustion chamber of an internal combustion engine; the fuel injector includes an actuator for actuating a valve needle, the valve needle having on an injection-side end a valve-closure member which forms a sealing seat together with a valve-seat surface, which is formed on a valve-seat member. Fuel channels are arranged in a valve needle guide, connected to the valve-seat member or designed as a single piece with it, in several rows circumferentially in the valve needle guide, at least one row of fuel channels being arranged, in the resting state of the fuel injector, above a guide line of the valve-closure member.

SUMMARY OF THE INVENTION

The object of the present invention is to provide a fuel injector which does not exhibit the above-stated disadvantages and, in particular, is simple and economic to produce.

The present invention provides a fuel injector as specified in the attached claims.

BRIEF DESCRIPTION OF THE DRAWINGS

The present invention will now be described with reference to the attached drawings, which illustrate some non-limiting embodiments of the invention, in which.

DETAILED DESCRIPTION OF THE INVENTION

Figure 1:
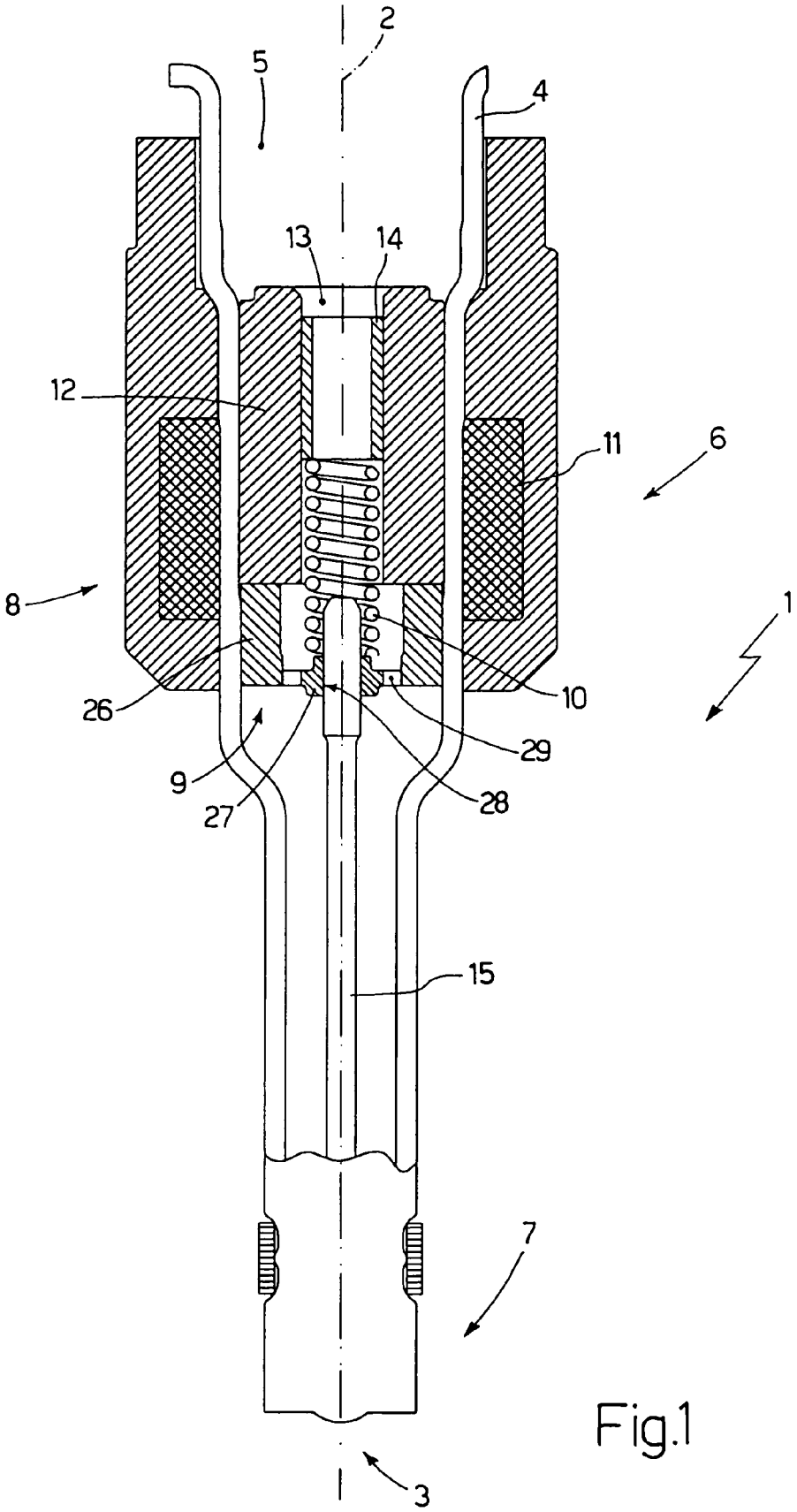
FIG. 1 is a schematic, partially sectional, side view of a fuel injector produced according to the present invention.

In FIG. 1, 1 denotes the overall fuel injector, which exhibits a substantially cylindrical symmetry around a longitudinal axis 2 and is capable of being operated to inject fuel from an injection jet 3 which opens directly into an combustion chamber (not shown) of a cylinder. The injector 1 comprises a supporting body 4, which has a tubular cylindrical shape of variable cross-section along the longitudinal axis 2 and comprises a supply channel 5 extending along the entire length of said supporting body 4 to supply the pressurised fuel to the injection jet 3. The supporting body 4 accommodates an electromagnetic actuator 6 at the level of an upper portion thereof and an injection valve 7 at the level of a lower portion thereof; in service, the injection valve 7 is actuated by the electromagnetic actuator 6 to control the flow of fuel through the injection jet 3, which is provided at the level of said injection valve 7.

The electromagnetic actuator 6 comprises an electromagnet 8, which is accommodated in fixed position within the supporting body 4 and which, when energised, is capable of displacing a mobile armature 9 of ferromagnetic material along the axis 2 from a closed position to an open position of the injection valve 7 against the action of a spring 10 which tends to hold the mobile armature 9 in the closed position of the injection valve 7. In particular, the electromagnet 8 comprises a coil 11, which is supplied with electricity by an electronic control unit (not shown) and is accommodated outside the supporting body 4, and a fixed magnetic armature 12, which is accommodated inside the supporting body 4 and has a central hole 13 to allow the fuel to flow towards the injection jet 3. Inside the central hole 13 of the fixed magnetic armature 12, an abutment member 14 is driven into a fixed position, which abutment member is of a tubular cylindrical shape (optionally open along a generating line) to allow the fuel to flow towards the injection jet 3 and is capable of holding the spring 10 in a compressed state against the mobile armature 9.

The mobile armature 9 is part of a mobile assembly which moreover comprises a poppet or plunger 15 having an upper portion integral with the mobile armature 9 and a lower portion that co-operates with a valve seat 16 (shown in FIG. 2) of the injection valve 7 to control the flow of fuel through the injection jet 3 in known manner.

Figure 2:
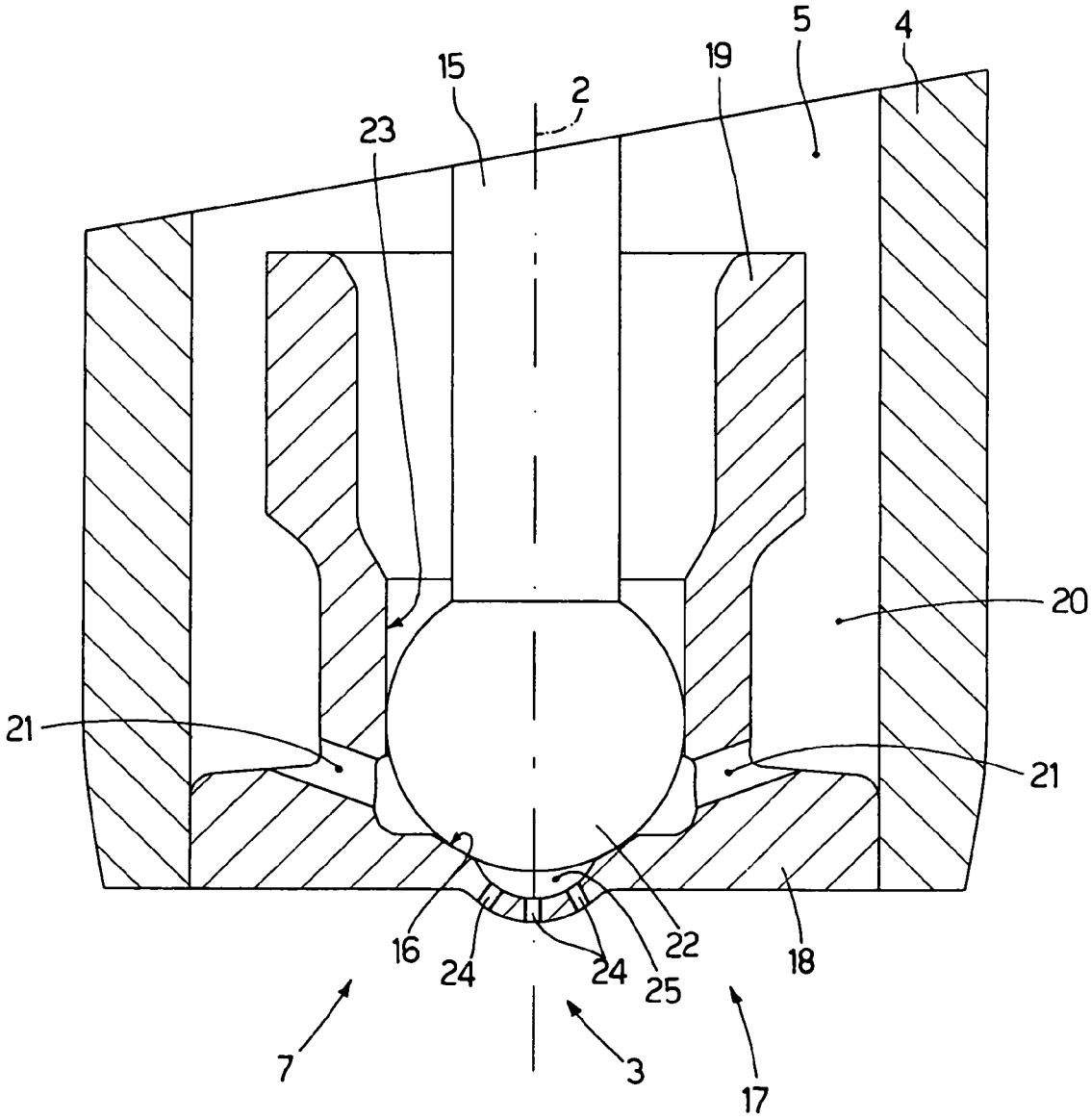
FIG. 2 shows an enlarged view of an injection valve of the injector in FIG. 1.

As shown in FIG. 2, the valve seat 16 is defined by a sealing body 17, which is monolithic and comprises a disc-shaped plug member 18, which seals the bottom of the supply channel 5 of the supporting body 4 and is passed through by the injection jet 3. A guide member 19 rises up from the plug member 18, which guide member is tubular in shape, receives within it the plunger 15 to define a lower guide for said plunger 15 and has an external diameter smaller than the internal diameter of the supply channel 5 of the supporting body 4, so as to define an external annular channel 20 through which the pressurised fuel can flow. The internal diameter of the tubular guide member 19 is variable along the longitudinal axis 2 so as to be greater than the external diameter of the plunger 15 at the top and to be substantially equal to the external diameter of the plunger 15 at the bottom. The total height (longitudinal dimension parallel to longitudinal axis 2) of the guide member 19 is 5–6 mm and the transversal dimension (perpendicular to longitudinal axis 2) is not smaller than 1–1.2 mm.

According to another embodiment which is not shown, the guide member 19 has at the top a diameter which is equal to the internal diameter of the supply channel 5 of the supporting body 4; in order to supply fuel to the annular channel 20, milled portions (typically two or four distributed symmetrically) are provided in the upper part of the guide member 19.

In the lower part of the guide member 19, there are provided four through-holes 21 (only two of which are shown in FIG. 2), which open into the valve seat 16 to allow the pressurised fuel to flow towards said valve seat 16 and converge towards the longitudinal axis 2. As shown in FIG. 2, the holes 21 are arranged inclined at an angle of 70° (more generally of between 60° and 80°) relative to the longitudinal axis 2; according to another embodiment, which is not shown, the holes 21 form an angle of 90° relative to the longitudinal axis 2.

The plunger 15 ends in a sealing head 22, substantially spherical in shape, which is capable of resting in sealing manner against the valve seat 16. Furthermore, the sealing head 22 rests so as to slide on an internal surface 23 of the guide member 19 so that it will be guided as it moves along the longitudinal axis 2. The injection jet 3 is defined by a plurality of through-holes 24, which are made starting from a hemispherical chamber 25 arranged downstream from the valve seat 16.

Each through-hole 21 has a diameter much greater than the diameter of each through-holes 24 so as to minimize the hydraulic resistance and improve the cooling effect in such portion; in particular, the total area of the through-holes 21 is at least three time the total area of the through-holes 24.

As shown in FIG. 1, the mobile armature 9 is a monolithic body and comprises an annular member 26 and a discoid member 27, which closes the bottom of the annular member 26 and has a central through-hole 28 capable of receiving an upper portion of the plunger 15 and a plurality of peripheral through-holes 29 (only two of which are shown in FIG. 3) capable of allowing the fuel to flow towards the injection jet 3. A central portion of the discoid member 27 is suitably shaped to receive a lower end of the spring 10 and hold it in position. The plunger 15 is preferably made integral with the discoid member 27 of the mobile armature 9 by means of an annular weld.

The annular member 26 of the mobile armature 9 has an external diameter substantially identical to the internal diameter of the corresponding portion of the supply channel 5 of the supporting body 4; in this manner, the mobile armature 9 can slide relative to the supporting body 4 along the longitudinal axis 2, but cannot make any movement transverse to the longitudinal axis 2, relative to the supporting body 4. Since the plunger 15 is rigidly connected to the mobile armature 9, it is clear that the mobile armature 9 also acts as an upper guide for the plunger 15; as a result, the plunger 15 is guided at the top by the mobile armature 9 and at the bottom by the guide member 19.

According to an alternative embodiment which is not shown, an antirebound device is attached to the lower face of the discoid member 27 of the mobile armature 9, which antirebound device is capable of damping the rebound of the sealing head 22 of the plunger 15 against the valve seat 16 when the plunger 15 moves from the open position to the closed position of the injection valve 7.

In service, when the electromagnet 8 is de-energised, the mobile armature 9 is not attracted by the fixed magnetic armature 12 and the resilient force of the spring 10 thrusts the mobile armature 9 downwards together with the plunger 15; in this situation, the sealing head 22 of the plunger 15 is pressed against the valve seat 16 of the injection valve 7, so isolating the injection jet 3 from the pressurised fuel. When the electromagnet 8 is energised, the mobile armature 9 is magnetically attracted by the fixed magnetic armature 12 against the resilient force of the spring 10 and the mobile armature 9 moves upwards together with the plunger 15 until it comes into contact with said fixed magnetic armature 12; in this situation, the sealing head 22 of the plunger 15 is lifted relative to the valve seat 16 of the injection valve 7 and the pressurised fuel can flow through the injection jet 3.

When the sealing head 22 of the plunger 15 is raised relative to the valve seat 16, the fuel reaches the chamber 25 of the injection jet 3 through the external annular channel 20 and subsequently through the four through-holes 21; in other words, when the sealing head 22 of the plunger 15 is raised relative to the valve seat 16, the fuel reaches the chamber 25 of the injection jet 3, wetting the entire external side surface of the guide member 19. In this manner, the guide member 19 is constantly cooled by the fuel, which has a relatively low temperature which, in practice, never exceeds 80° C.;

this cooling effect of the guide member 19 is transmitted to the entire sealing body 17 (which is monolithic) and is thus also transmitted to the plug member 18 in which the injection jet 3 is made. In other words, the guide member 19 constantly wetted internally and externally by the fuel behaves like a radiator to dissipate the heat received from outside and present in the plug member 18.

Experimental testing has demonstrated that the reduction in the operating temperature of the plug member 18 results in a considerable reduction in the formation of fouling on the external surface of the plug member 28 and thus in the proximity of the holes 24 of the injection jet 3. Thanks to said effect of reduced formation of fouling in the proximity of the holes 24 of the injection jet 3, the above-described injector 1 exhibits a very long service life.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A fuel injector comprising:

an injection valve provided with a mobile plunger for controlling the flow of fuel;

an actuator capable of displacing the plunger between a closed position and an open position of the injection valve;

an injection jet having a plurality of first through-holes made starting from a chamber arranged downstream from the injection valve;

a supporting body having a tubular shape and comprising a supply channel; and a sealing body in which a valve seat of the injection valve is defined and the injection jet is made; wherein the sealing body is monolithic and comprises a disc-shaped plug member, which seals the bottom of the supply channel and is passed through by the injection jet, and a guide member, which rises up from the plug member, is tubular in shape and receives within it the plunger to define a lower guide of the plunger;

wherein the guide member has at least in part an external diameter smaller than the internal diameter of the supply channel so as to define an external channel for the fuel;

wherein in the lower part of the guide member there are provided a number of second through-holes which open into the valve seat;

wherein each second through-hole has a diameter greater than the diameter of each first through-hole so as to minimize the hydraulic resistance and improve the cooling effect in such portion and so as the total area of the second through-holes is at least three times the total area of the first through-holes.

2. An injector according to claim 1, wherein the internal diameter of the tubular guide member is variable along the longitudinal axis so as to be greater than the external diameter of the plunger at the top and to be substantially equal to the external diameter of the plunger at the bottom.

3. An injector according to claim 1, wherein the second through-holes of the guide member form an angle of between 60° and 80° with a longitudinal axis of the injector.

4. An injector according to claim 1, wherein the second through-holes form an angle of 90° with a longitudinal axis of the injector.

5. An injector according to claim 1, the second through-holes converge towards a longitudinal axis of the injector.

6. An injector according to claim 1, wherein the actuator comprises a spring, which tends to hold the plunger in the closed position.

7. An injector according to claim 6, wherein the actuator is an electromagnetic actuator and comprises a coil, a fixed magnetic armature, and an mobile armature, which is magnetically attracted by the fixed magnetic armature against the force of the spring and is mechanically connected to the plunger.

8. An injector according to claim 7, wherein the mobile armature comprises an annular member and a discoid member, which closes the bottom of the annular member and has a central through-hole capable of receiving an upper portion of the plunger and a plurality of peripheral through-holes capable of allowing the fuel to flow towards the injection jet.

9. An injector according to claim 1, wherein the plunger ends in a sealing head, substantially spherical in shape, which is capable of resting in sealing manner against the valve seat.

* * * * *